US011072177B2

(12) United States Patent
Sugimoto et al.

(10) Patent No.: US 11,072,177 B2
(45) Date of Patent: Jul. 27, 2021

(54) LIQUID ABSORBING APPARATUS, PRINTING APPARATUS, PRINTING METHOD, AND MANUFACTURING METHOD

(71) Applicant: CANON KABUSHIKI KAISHA, Tokyo (JP)

(72) Inventors: Masahiro Sugimoto, Yokohama (JP); Yuichiro Yanagi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 16/433,861

(22) Filed: Jun. 6, 2019

(65) Prior Publication Data

US 2019/0283428 A1 Sep. 19, 2019

Related U.S. Application Data

(63) Continuation of application No. PCT/JP2017/036061, filed on Oct. 4, 2017.

(30) Foreign Application Priority Data

Dec. 7, 2016 (JP) ..... JP2016-237830

(51) Int. Cl.
*B41J 2/165* (2006.01)
*B41J 2/01* (2006.01)
(Continued)

(52) U.S. Cl.
CPC ..... *B41J 2/16505* (2013.01); *B41J 2/01* (2013.01); *B41J 2/17* (2013.01); *B41J 3/00* (2013.01);
(Continued)

(58) Field of Classification Search
CPC ..... B41J 2002/012; B41J 2/01; B41J 2/0057; B41J 29/17; B41M 5/0256
See application file for complete search history.

(56) References Cited

U.S. PATENT DOCUMENTS 3,510,903 A * 5/1970 Stoever ..... G03G 21/0041 15/256.5
5,841,456 A * 11/1998 Takei ..... B41J 2/0057 347/103
(Continued)

FOREIGN PATENT DOCUMENTS

EP 0 530 627 A2 3/1993
JP 07-164624 A 6/1995
(Continued)

OTHER PUBLICATIONS

Machine Translation of JP 2009-000916 A-Global Dossier; WIPO IP Portal; Retrieved Sep. 2020. (Year: 2020).*
(Continued)

*Primary Examiner* — John Zimmermann
(74) *Attorney, Agent, or Firm* — Venable LLP

(57) ABSTRACT

A liquid absorbing apparatus for absorbing a liquid component from an ink image formed on a transfer member before transferring the ink image to a print medium includes a liquid absorbing member configured to absorb the liquid component, a support unit configured to support the liquid absorbing member to be movable cyclically, and at least one recovery unit arranged in a moving path of the liquid absorbing member and configured to recover liquid absorption performance of the liquid absorbing member.

13 Claims, 8 Drawing Sheets

(51) Int. Cl.

| | |
|---|---|
| ***B41M 5/025*** | (2006.01) |
| ***B41J 2/17*** | (2006.01) |
| ***B41J 3/00*** | (2006.01) |
| ***B41M 7/00*** | (2006.01) |
| *B41M 5/03* | (2006.01) |

(52) U.S. Cl.
CPC ..... *B41M 5/0256* (2013.01); *B41M 7/00* (2013.01); *B41J 2002/012* (2013.01); *B41M 5/03* (2013.01)

(56) References Cited

U.S. PATENT DOCUMENTS

| | | | | |
|---|---|---|---|---|
| 6,356,728 | B1 * | 3/2002 | Watanabe | G03G 15/11 399/250 |
| 6,682,189 | B2 | 1/2004 | May et al. | |
| 6,767,092 | B2 | 7/2004 | May et al. | |
| 7,447,476 | B2 * | 11/2008 | Murase | G03G 21/0041 399/348 |
| 7,845,760 | B2 * | 12/2010 | Hirakawa | B41J 2/17509 347/31 |
| 8,042,906 | B2 | 10/2011 | Chiwata et al. | |
| 9,321,268 | B1 | 4/2016 | Thayer et al. | |
| 9,592,698 | B2 | 3/2017 | Gervasi et al. | |
| 9,610,764 | B2 | 4/2017 | Thayer et al. | |
| 10,336,061 | B2 | 7/2019 | Yanagi et al. | |
| 2006/0221166 | A1 * | 10/2006 | Inoue | B41M 7/00 347/104 |
| 2008/0236480 | A1 * | 10/2008 | Furukawa | C23C 26/02 118/50 |
| 2014/0060352 | A1 | 3/2014 | Gervasi et al. | |
| 2017/0217216 | A1 * | 8/2017 | Ohnishi | B41J 11/0015 |
| 2018/0272689 | A1 | 9/2018 | Yanagi et al. | |
| 2018/0319179 | A1 * | 11/2018 | Yamane | B41J 2/01 |

FOREIGN PATENT DOCUMENTS

| | | | |
|---|---|---|---|
| JP | 2003-182064 | A | 7/2003 |
| JP | 2005-280942 | A | 10/2005 |
| JP | 2007-268803 | A | 10/2007 |
| JP | 2009-000916 | A | 1/2009 |
| JP | 2009-045851 | A | 3/2009 |
| JP | 2009-096175 | A | 5/2009 |
| JP | 2013-056455 | A | 3/2013 |
| JP | 2015-098097 | A | 5/2015 |
| JP | 2015-145117 | A | 8/2015 |
| JP | 2016-002765 | A | 1/2016 |
| JP | 2016-101713 | A | 6/2016 |
| JP | 2016-107635 | A | 6/2016 |
| JP | 2016-120625 | A | 7/2016 |
| WO | 2018/105215 | A1 | 6/2018 |

OTHER PUBLICATIONS

International Search Report and Written Opinion dated Nov. 28, 2017, issued in International Application No. PCT/JP2017/036061.
Extended European Search Report dated May 15, 2020, in European Patent Application No. 17877817.1.
Office Action dated May 25, 2020, in Japanese Patent Application No. 2016-237830.
U.S. Appl. No. 16/420,330, Yuichiro Yanagi, Masahiro Sugimoto, filed May 23, 2019.

* cited by examiner

LIQUID ABSORBING APPARATUS, PRINTING APPARATUS, PRINTING METHOD, AND MANUFACTURING METHOD

CROSS-REFERENCE TO RELATED APPLICATIONS

This application is a Continuation of International Patent Application No. PCT/JP2017/036061, filed Oct. 4, 2017, which claims the benefit of Japanese Patent Application No. 2016-237830, filed Dec. 7, 2016, both of which are hereby incorporated by reference herein in their entirety.

BACKGROUND OF THE INVENTION

Field of the Invention

The present invention relates to a transfer type printing technique.

Background Art

A technique of forming an ink image on a transfer body and transferring it to a print medium such as paper is proposed. For example, Japanese Patent Laid-Open No. 2003-182064 discloses an image forming apparatus configured to form an ink image on an intermediate member and transfer the ink image to a sheet. This apparatus includes an inkjet device that forms a primary image on the intermediate member. This apparatus also includes a zone where an aggregate is formed in the primary image, a zone where a liquid is partially removed from the aggregate, a zone where an image is transferred to a sheet, and a zone where the surface of the intermediate member is reproduced before a new primary image is formed. Moreover, Japanese Patent Laid-Open No. 2009-45851 discloses a solvent removing roller configured to remove a solvent of an ink image formed on an intermediate transfer body. The solvent removing roller is formed by a porous body, and absorbs the solvent of the ink image by abutting against the intermediate transfer body.

Like the solvent removing roller described in Japanese Patent Laid-Open No. 2009-45851, a liquid absorbing member that absorbs a liquid component of an ink image to remove it may lower in liquid absorption performance due to the use of it. If the liquid absorption performance lowers early, the replacement frequency of the liquid absorbing member may become high, reducing user convenience.

SUMMARY OF THE INVENTION

The present invention provides a technique capable of maintaining the liquid absorption performance of a liquid absorbing member for a longer period.

According to an aspect of the present invention, there is provided a liquid absorbing apparatus for absorbing a liquid component from an ink image formed on a transfer member before transferring the ink image to a print medium, comprising: a liquid absorbing member configured to absorb the liquid component; a support unit configured to support the liquid absorbing member to be movable cyclically; and at least one recovery unit arranged in a moving path of the liquid absorbing member and configured to recover liquid absorption performance of the liquid absorbing member.

Further features of the present invention will become apparent from the following description of exemplary embodiments with reference to the attached drawings.

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
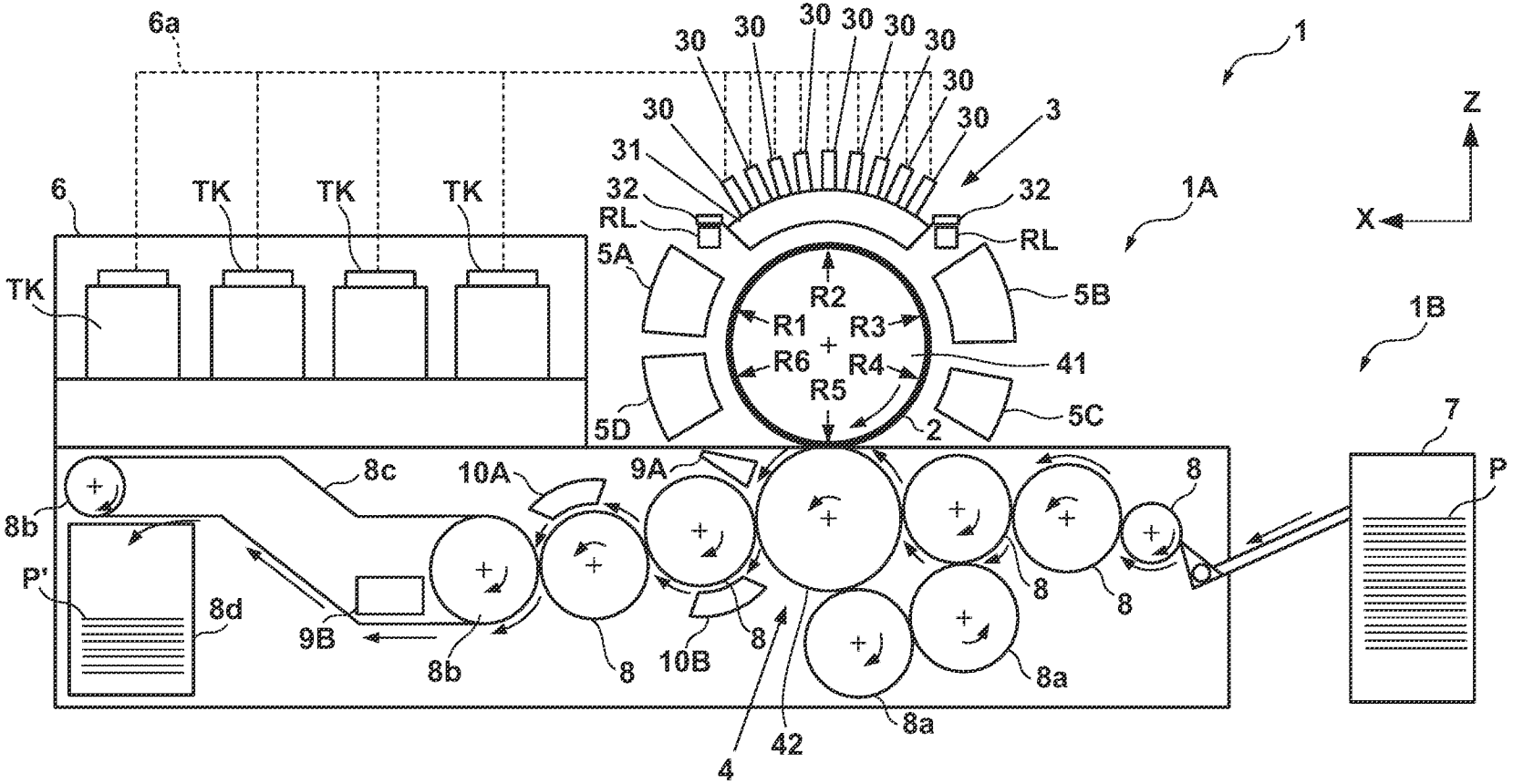
FIG. 1 is a schematic view showing a printing system.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on a print medium in a broader sense or processing of a print medium regardless of whether the information is significant or insignificant or has become obvious to allow human visual perception. In this embodiment, a "print medium" is assumed to be a paper sheet but may be a fabric, plastic film, or the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
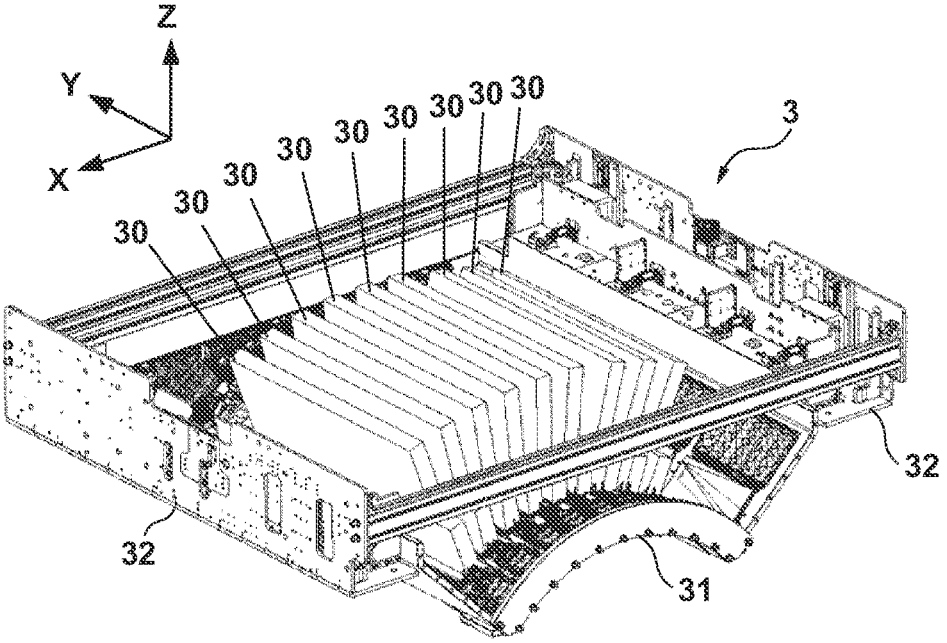
FIG. 2 is a perspective view showing a print unit.

The print unit 3 includes a plurality of printheads 30 and a carriage 31. A description will be made with reference to FIGS. 1 and 2. FIG. 2 is a perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a known inkjet printer is applicable. For example, an element that discharges ink by causing film boiling in ink with an electrothermal transducer and forming a bubble, an element that discharges ink by an electromechanical transducer, an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
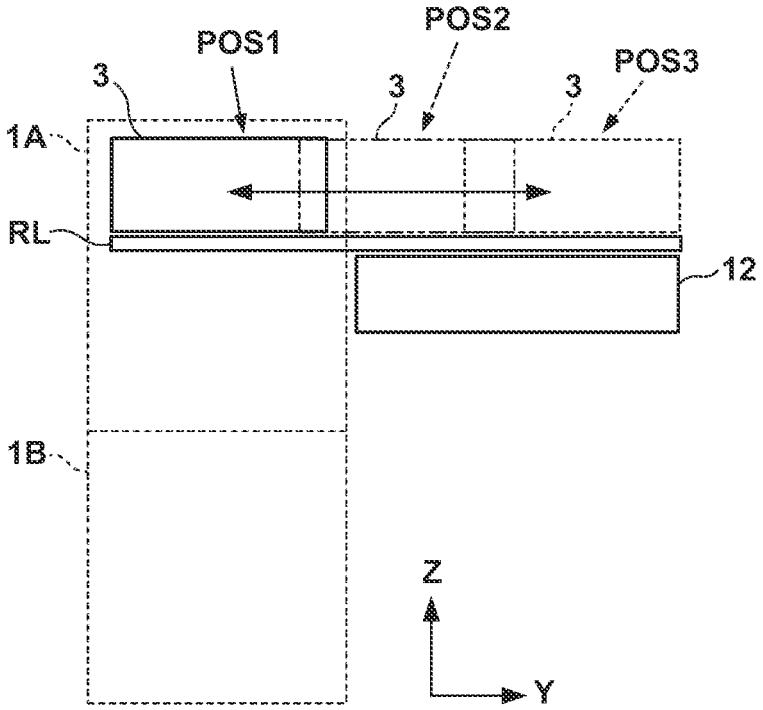
FIG. 3 is an explanatory view showing a displacement mode of the print unit in FIG. 2.

FIG. 3 is a view showing a displacement mode of the print unit 3 and schematically showing the right side surface of the printing system 1. A recovery unit 12 is provided in the rear of the printing system 1. The recovery unit 12 has a mechanism of recovering discharge performance of the printheads 30. For example, a cap mechanism that caps the ink discharge surface of each printhead 30, a wiper mechanism that wipes the ink discharge surface, and a suction mechanism that sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is located above the recovery unit 12. The recovery unit 12 can perform recovery processing on the printheads 30 when the print unit 3 is located at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a cylindrical outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide an arbitrary surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having a continuous pore structure in which respective pores are contiguous with each other and a material having an independent pore structure in which the respective pores are independent from each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicon rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by arbitrarily combining the respective layers formed by the materials described above.

The outer peripheral surface of the pressurizing drum 42 is pressed against the transfer member 2. At least one grip mechanism that grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be distributed by a transmission mechanism such as a gear mechanism.

<Peripheral Unit>

The peripheral units 5A to 5D are arranged around the transfer drum 41. In this embodiment, the peripheral units 5A to 5D are an application unit, an absorption unit, a heating unit, and a cleaning unit in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin contained in the ink with respect to the liquid component by decreasing the liquid component contained in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism that heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, some of these units may each be provided with the cooling function of the transfer member 2 or a cooling unit may be added. In this embodiment, the temperature of the transfer member 2 may rise by heat of the heating unit 5C. If the ink image exceeds the boiling point of water as a prime solvent of ink after the print unit 3 discharges ink to the transfer member 2, performance of liquid component absorption by the absorption unit 5B may degrade. It is possible to maintain the performance of liquid component absorption by cooling the transfer member 2 such that the discharged ink is maintained below the boiling point of water.

The cooling unit may be an air blowing mechanism that blows air to the transfer member 2, or a mechanism that brings a member (for example, a roller) into contact with the transfer member 2 and cools this member by air-cooling or water-cooling. The cooling unit may be a mechanism that cools the cleaning member of the cleaning unit 5D. A cooling timing may be a period before application of the reactive liquid after transfer.

<Supply Unit>

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may include a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is located lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image is transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism that feeds the print media P one by one from the stacking unit to the most upstream conveyance drum 8. Each of the conveyance drums 8 and 8*a* is a rotating body that rotates about the rotation axis in the Y direction and has a cylindrical outer peripheral surface. At least one grip mechanism that grips the leading edge portion of the print medium P (or printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-sided printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 located at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms that are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. For example, coating that aims at protection, forming gloss, and the like of an image on the image printed surface of the printed product P' can be given as one type of processing contents. For example, liquid application, sheet welding, lamination, and the like can be given as coating contents.

<Inspection Unit>

The conveyance apparatus 1B includes inspection units 9A and 9B. The inspection units 9A and 9B are mechanisms that are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a time-over change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
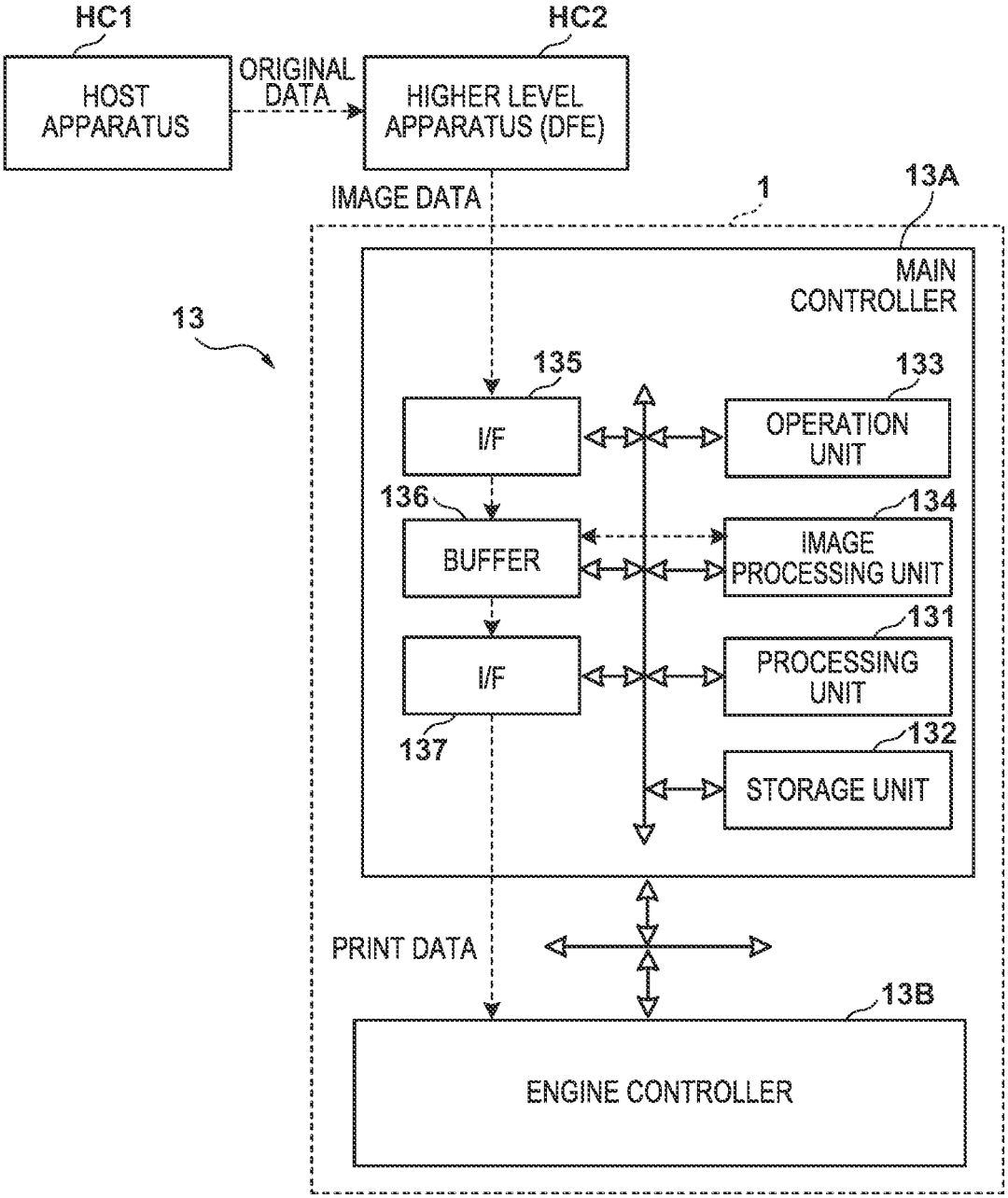
FIG. 4 is a block diagram showing a control system of the printing system in FIG. 1.
Figure 5:
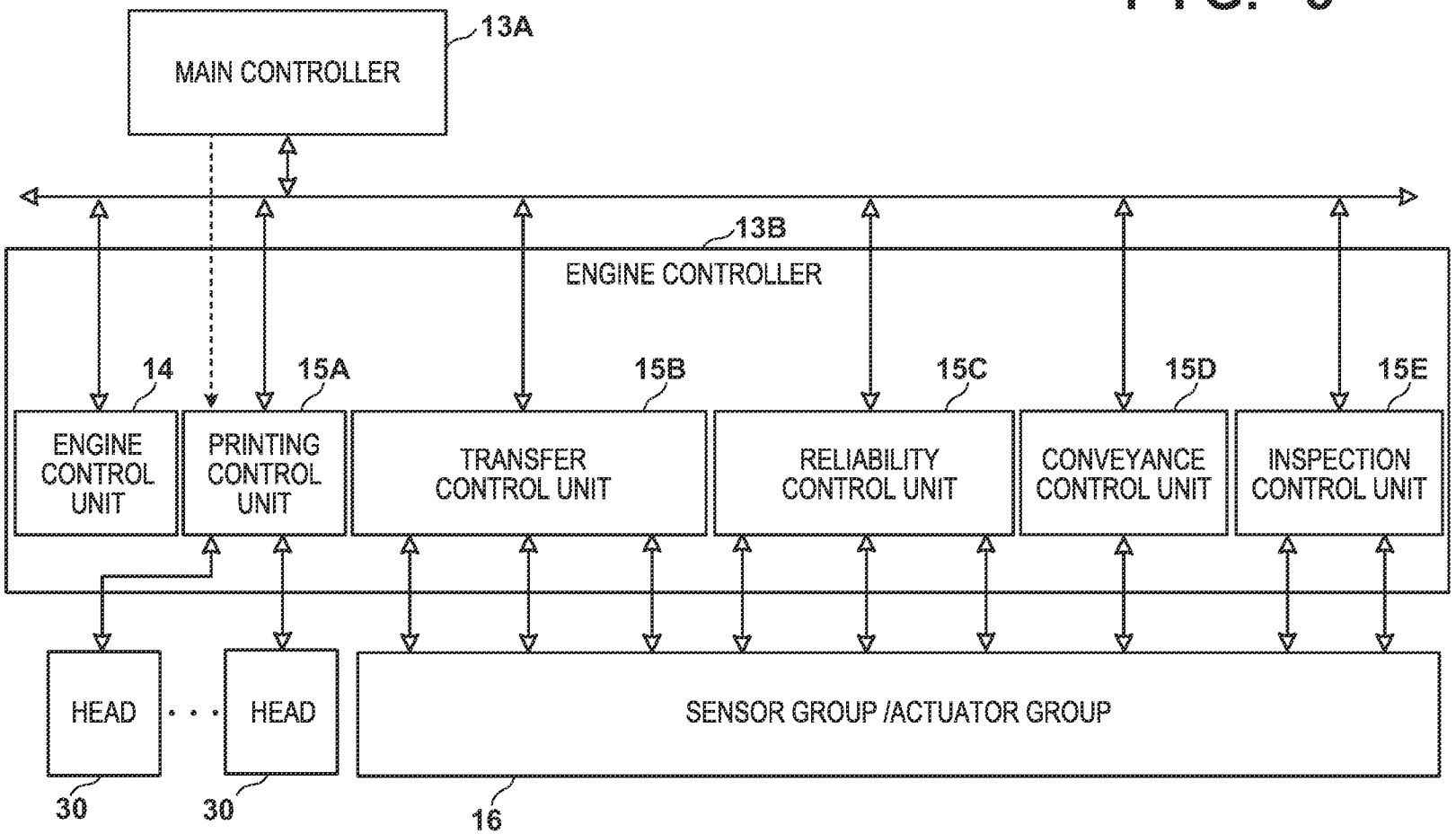
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the CPU 131, and provides the CPU 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and acquires a detection result of a sensor group/actuator group 16 of the printing system 1 and performs driving control. Each of these control units includes a processor such as a CPU, a storage device such as a RAM or a ROM, and an interface with an external device. Note that the division of the control units is an example, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection units 9B and 9A.

Of the sensor group/actuator group 16, the sensor group includes a sensor that detects the position and speed of a movable part, a sensor that detects a temperature, and an image sensor. The actuator group includes a motor, an electromagnetic solenoid, and an electromagnetic valve.

Operation Example

Figure 6:
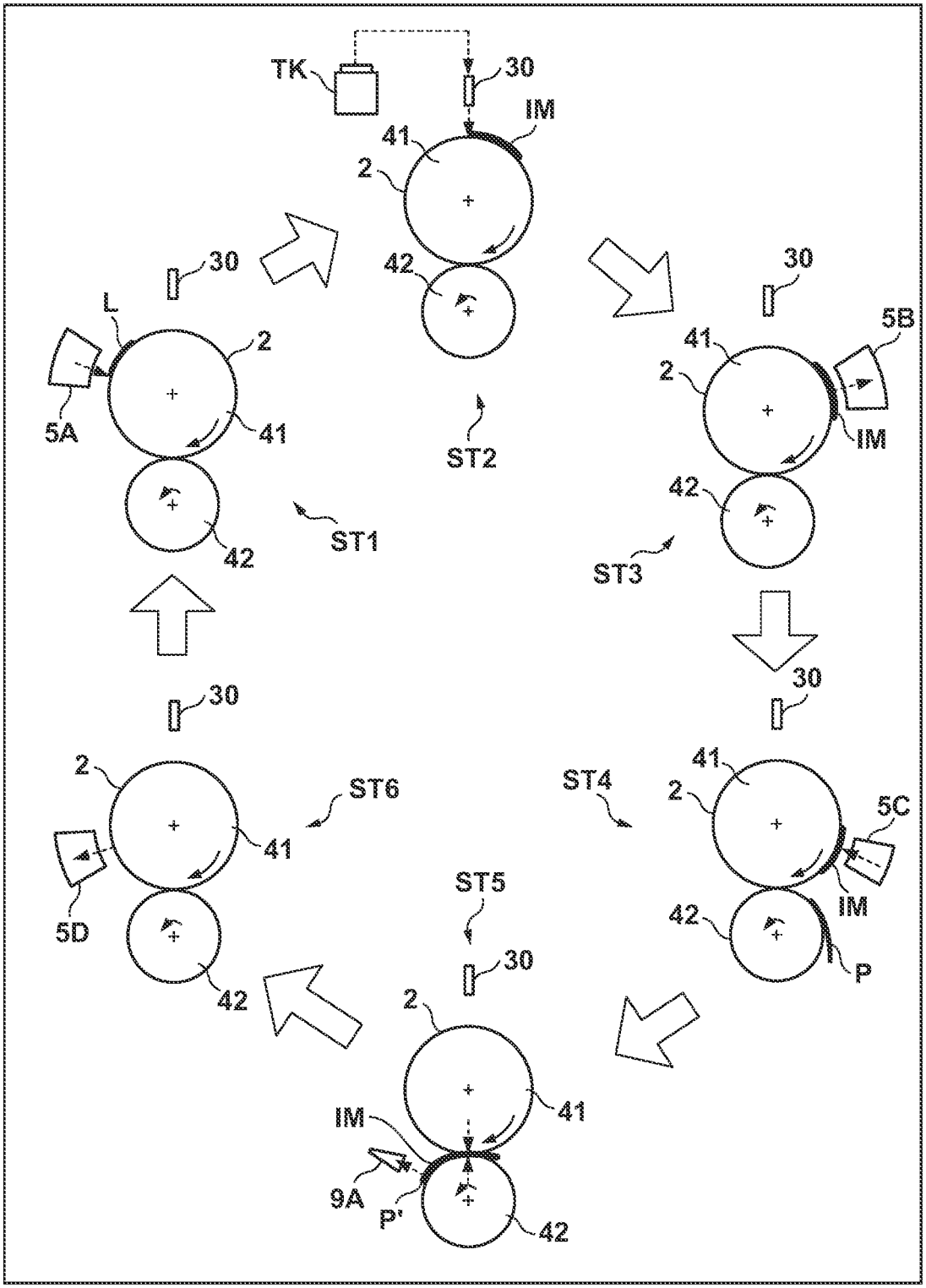
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion, on the transfer member 2, to which the reactive liquid L is applied, moves along with the rotation of the transfer drum 41. When the portion to which the reactive liquid L is applied reaches under the printhead 30, ink is discharged from the printhead 30 to the transfer member 2, as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion, on the transfer member 2, where the ink image IM is formed reaches the cleaning unit 5D, it is cleaned by the cleaning unit 5D, as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for easy understanding. It is possible, however, to continuously perform transfer of the ink image IM to the plurality of print media P in one rotation of the transfer member 2.

Figure 7:
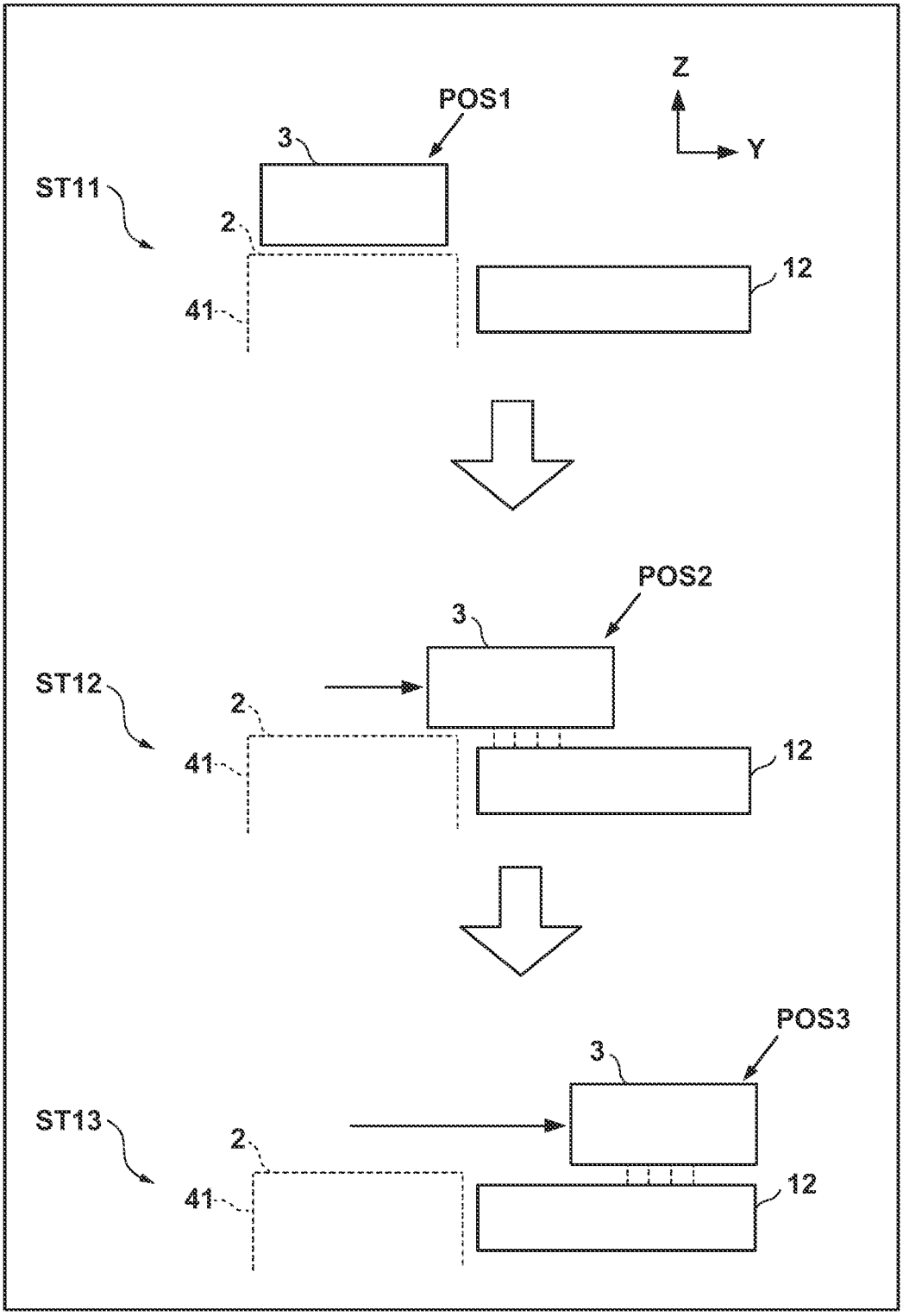
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is located at the discharge position POS1. A state ST12 shows a state in which the print unit 3 passes through the preliminary recovery position POS2. Under passage, the recovery unit 12 performs processing of recovering discharge performance of each printhead 30 of the print unit 3. Subsequently, as shown in a state ST13, the recovery unit 12 performs the processing of recovering the discharge performance of each printhead 30 in a state in which the print unit 3 is located at the recovery position POS3.

<Absorption Unit>

Figure 8:
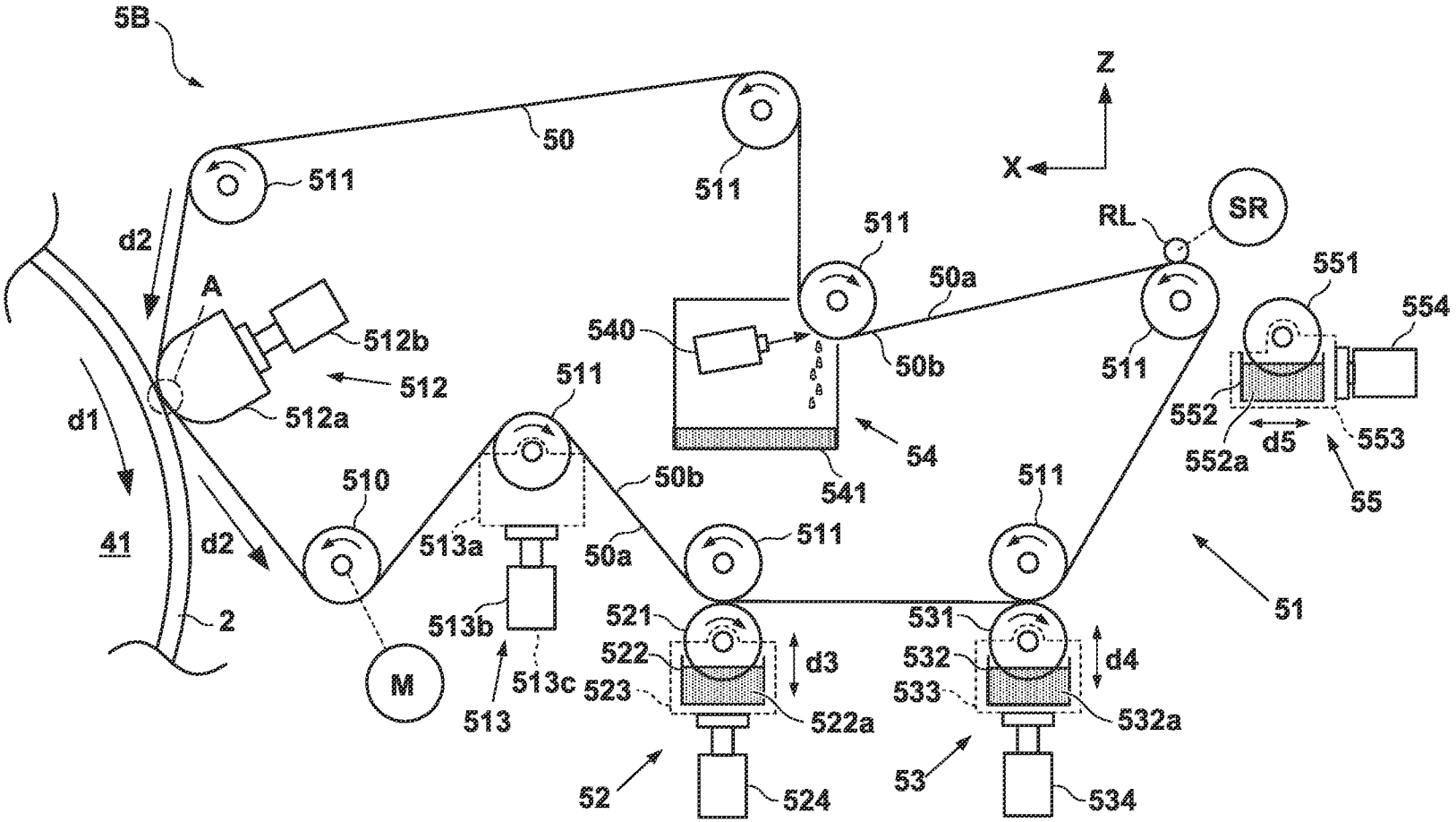
FIG. 8 is a schematic view showing an absorption unit.
Figure 9:
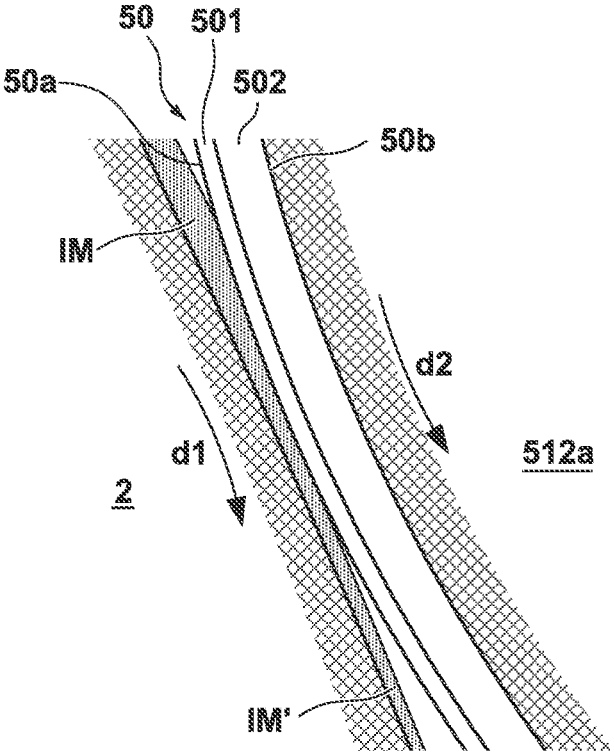
FIG. 9 is an enlarged view showing a portion A in FIG. 8.

A detailed example of the absorption unit 5B will be described with reference to FIGS. 8 and 9. FIG. 8 is a schematic view showing an example of the absorption unit 5B. FIG. 9 is an enlarged view showing a portion A in FIG. 8. The absorption unit 5B is a liquid absorbing apparatus that absorbs a liquid component from the ink image IM formed on the transfer member 2 before the ink image IM is transferred to the print medium P. When the aqueous pigment ink is used as in this embodiment, the absorption unit 5B mainly aims at absorbing water in the ink image. This makes it possible to suppress occurrence of a curl or cockling of the print medium P.

The absorption unit 5B includes a liquid absorbing member 50, a support unit 51 that supports the liquid absorbing member 50 to be movable cyclically, a plurality of kinds of recovery units 52 to 54, and a preprocessing unit 55.

The liquid absorbing member 50 is an absorber that absorbs the liquid component from the ink image IM and is formed into an endless swath of a sheet in the example of FIG. 8. The liquid absorbing member 50 may be formed by a single layer but is formed by a plurality of layers in this embodiment. FIG. 9 shows a liquid absorbing portion of the liquid absorbing member 50 with respect to the ink image IM, and shows a portion where the liquid absorbing member 50 gets closest to the transfer member 2. An arrow d1 indicates the moving direction of the transfer member 2, and an arrow d2 indicates the moving direction of the liquid absorbing member 50.

In this embodiment, the liquid absorbing member 50 has a two-layered structure of an obverse layer 501 and a reverse layer 502 but may have a structure of three or more layers. The obverse layer 501 forms a surface 50*a* contacting the ink image IM, and the reverse layer 502 forms an opposite surface 50*b*. The liquid absorbing member 50 absorbs the liquid component of the ink image IM on the transfer member 2. The liquid component of the ink image IM penetrates from the obverse layer 501 to the liquid absorbing member 50 and further penetrates to the reverse layer 502. The ink image IM is changed to an ink image IM' with a decreased liquid component and moves toward the heating unit 5C.

Each of the obverse layer 501 and the reverse layer 502 can be made of a porous material. The average pore size of the obverse layer 501 can be made smaller than that of the reverse layer 502 in that performance of absorbing the liquid component is increased while suppressing adherence of the coloring material.

A material for the obverse layer 501 may be, for example, a hydrophilic material whose contact angle with respect to water is less than 90° or a water-repellent material whose contact angle with respect to water is 90° or more. For the hydrophilic material, the material may have the contact angle with respect to water be 40° or less. The contact angle may be measured complying with a technique described in, for example, "6. static method" of JIS R3257.

The hydrophilic material has an effect of drawing up a liquid by a capillary force. Cellulose, polyacrylamide, or a composite material of these can be given as the hydrophilic material. When the water-repellent material is used, a hydrophilic treatment may be performed on its surface. A method such as sputter etching can be given as the hydrophilic treatment.

For example, a fluorine resin can be given as the water-repellent material. For example, polytetrafluoroethylene, polychlorotrifluoroethylene, polyvinylidene fluoride, or the like can be given as the fluorine resin. A time may be taken until the effect of drawing up the liquid is exerted when the water-repellent material is used for the obverse layer 501. To cope with this, a liquid whose contact angle with the obverse layer 501 is less than 90° may be impregnated into the obverse layer 501.

For example, resin-fiber nonwoven fabric or woven fabric can be given as a material for the reverse layer 502. The material for the reverse layer 502 may have the contact angle of water equal to or larger than that for the obverse layer 501 because the liquid component does not flow backward from the reverse layer 502 to the obverse layer 501. For example, polyolefin, polyurethane, polyamide such as nylon, polyester, polysulfone, or a composite material of these can be given as the material for the reverse layer 502.

For example, adhesive lamination, thermal lamination, or the like can be given as an accumulative method of the obverse layer 501 and the reverse layer 502.

The support unit 51 is a mechanism that supports the liquid absorbing member 50 to be able to run cyclically and includes a driving rotating body 510, a plurality of driven rotating bodies 511, and a position adjustment mechanism 512. The driving rotating body 510 and the driven rotating bodies 511 are rollers or pulleys around which the swath liquid absorbing member 50 is wound, and are rotatably supported about an axis in the Y direction.

The driving rotating body 510 rotates by a driving force of a motor M and runs the liquid absorbing member 50. Note that in this embodiment, the support unit 51 is configured to include the driving rotating body 510. However, the driving rotating body 510 may be omitted so that the support unit 51 includes only the driven rotating bodies 511. In this arrangement, it is possible to run the liquid absorbing member 50 by pressing the liquid absorbing member 50 against the transfer member 2 and using the rotating force of the transfer member 2.

The driven rotating bodies 511 are supported freely rotatably. In this embodiment, seven driven rotating bodies 511 are provided, and these driven rotating bodies 511 and the driving rotating body 510 delimit a moving path (running track) of the liquid absorbing member 50. The moving path of the liquid absorbing member 50 is a zigzag path winding up and down when viewed from a running direction (arrow d2). This makes it possible to use the longer liquid absorbing member 50 in a smaller space and decrease a replacement frequency upon degradation in performance of the liquid absorbing member 50.

One of the plurality of driven rotating bodies 511 includes a tension adjustment mechanism 513. The tension adjustment mechanism 513 is a mechanism that adjusts the tension of the liquid absorbing member 50 and includes a support member 513*a*, a moving mechanism 513*b*, and a sensor 513*c*. The support member 513*a* supports the driven rotating body 511 rotatably about the axis in the Y direction. The moving mechanism 513*b* is a mechanism that moves the support member 513*a* and is, for example, an electric cylinder. The moving mechanism 513*b* can displace the driven rotating body 511, adjusting the tension of the liquid absorbing member 50. The sensor 513*c* detects the tension of the liquid absorbing member 50. In this embodiment, the sensor 513*c* detects a load received by the moving mechanism 513*b*. The tension of the liquid absorbing member 50 can be controlled automatically by controlling the moving mechanism 513*b* based on a detection result of the sensor 513*c*.

The position adjustment mechanism 512 includes a movable member 512*a* and a pressing mechanism 512*b*. The movable member 512*a* is arranged facing the transfer member 2 and has a peripheral surface where the liquid absorbing member 50 slides. The pressing mechanism 512*b* is a mechanism that moves the movable member 512*a* back and forth to the side of the transfer member 2, and is, for example, an electric cylinder but may be an elastic member such as a coil spring. The liquid absorbing member 50 is brought into contact with the transfer member 2 or maintained at a position an infinitesimal distance away from the surface by the position adjustment mechanism 512, and absorbs the liquid component from the ink image IM formed on the transfer member 2 before the transfer.

A sensor SR detects a running speed of the liquid absorbing member 50. The sensor SR is, for example, a rotary encoder. In this embodiment, a rotating body RL of the sensor SR contacts the liquid absorbing member 50, is driven to rotate in accordance with running of the liquid absorbing member 50, and detects its rotation amount. The rotating body RL is arranged facing the driven rotating body 511. It is also possible to detect the running speed of the liquid absorbing member 50 by detecting the rotation speeds of the driven rotating bodies 511 and the driving rotating body 510. However, the liquid absorbing member 50 may slip with respect to them. As in this embodiment, it is possible to improve detection accuracy by detecting the running speed of the liquid absorbing member 50 directly with the sensor SR.

The transfer control unit 15B controls driving of the motor M based on the detection result of the sensor SR. The transfer control unit 15B drives the motor M so that, for example, the liquid absorbing member 50 runs in synchronism with the movement of the transfer member 2. In other words, the transfer control unit 15B controls the motor M so that the peripheral speed of the surface of the transfer member 2 coincides with the running speed of the liquid absorbing member 50. This can suppress rubbing of the liquid absorbing member 50 against the coloring material of the ink image IM. The peripheral speed of the transfer member 2 can be obtained by acquiring control information of the transfer unit 4 from the conveyance control unit 15D.

The recovery units 52 to 54 are apparatuses that recover the liquid absorption performance of the liquid absorbing member 50. By providing such recovery mechanism, it is possible to suppress degradation in performance of the liquid absorbing member 50, and maintain the liquid absorption performance for a longer period. This can decrease the replacement frequency of the liquid absorbing member 50.

In this embodiment, the three kinds of recovery units 52 to 54 having different functions are arranged in the middle of the moving path of the liquid absorbing member 50. However, one recovery unit may be arranged.

Alternatively, a plurality of recovery units having the same function may be provided.

Among the recovery units 52 to 54, the recovery units 52 and 53 perform processing for the surface 50*a*, and the recovery unit 54 performs processing for the surface 50*b*. By performing the different processes for the surfaces 50*a* and 50*b*, respectively, it is possible to recover the liquid absorption performance of the liquid absorbing member 50 more properly.

The recovery unit 52 is an apparatus that removes a dust particle from the liquid absorbing member 50 and includes a cleaning roller 521, a reservoir 522, a support member 523, and a moving mechanism 524. The support member 523 supports the cleaning roller 521 rotatably about the axis in the Y direction and also supports the reservoir 522. A cleaning liquid 522*a* is reserved in the reservoir 522. The cleaning roller 521 is partially immersed in the cleaning liquid 522*a*. The moving mechanism 524 is a mechanism that moves the support member 523 and is, for example, an electrically-driven cylinder. The cleaning roller 521 and the reservoir 522 also move together with the support member 523. They are moved in the direction of an arrow d3 (here, the vertical direction) between a cleaning position at which the cleaning roller 521 contacts the liquid absorbing member 50 and a retracted position at which the cleaning roller 521 is separated from the liquid absorbing member 50. FIG. 8 shows a state in which the cleaning roller 521 is located at the cleaning position. The cleaning roller 521 may always be located at the cleaning position during the operation of the printing system 1 and may be moved to the retracted position at the time of maintenance.

The cleaning roller 521 is arranged facing the driven rotating body 511. The liquid absorbing member 50 is nipped by the cleaning roller 521 and the driven rotating body 511 at the cleaning position. The cleaning roller 521 rotates in accordance with running of the liquid absorbing member 50. The peripheral surface of the cleaning roller 521 is formed by, for example, a cohesive material and removes a dust particle (paper dust or the like) adhered to the surface 50*a* of the liquid absorbing member 50 by contacting the surface 50*a*. For example, rubber of butyl, silicone, urethane, or the like can be given as a material for the peripheral surface of the cleaning roller 521. The cleaning liquid 522*a* is, for example, a surfactant and can use a liquid that promotes separation of a dust particle adhered to the cleaning roller 521. The reservoir 522 may include a wiper that promotes separation of a dust particle by abutting against the surface of the cleaning roller 521.

In this embodiment, an arrangement that removes the dust particle adhered to the surface 50*a* of the liquid absorbing member 50 by the cleaning roller 521 is adopted. However, another arrangement such as an arrangement that removes the dust particle by blowing air may also be adopted.

The recovery unit 53 is an apparatus that applies a moisturizing liquid to the liquid absorbing member 50 and adopts the same mechanism as the recovery unit 52. That is, the recovery unit 53 includes an application roller 531, a reservoir 532, a support member 533, and a moving mechanism 534. The support member 533 supports the application roller 531 rotatably about the axis in the Y direction and also supports the reservoir 532. A moisturizing liquid 532*a* is reserved in the reservoir 532. The application roller 531 is partially immersed in the moisturizing liquid 532*a*. The moving mechanism 534 is a mechanism that moves the support member 533 and is, for example, an electrically-driven cylinder. The application roller 531 and the reservoir 532 also move together with the support member 533. They are moved in the direction of an arrow d4 (here, the vertical direction) between an application position at which the application roller 531 contacts the liquid absorbing member 50 and a retracted position at which the application roller 531 is separated from the liquid absorbing member 50. FIG. 8 shows a state in which the application roller 531 is located at the application position. The application roller 531 may always be located at the application position during the operation of the printing system 1 and may be moved to the retracted position at the time of maintenance.

The application roller 531 is arranged facing the driven rotating body 511. The liquid absorbing member 50 is nipped by the application roller 531 and the driven rotating body 511 at the application position. The application roller 531 rotates in accordance with running of the liquid absorbing member 50. The peripheral surface of the application roller 531 is formed by, for example, rubber and supplies the moisturizing liquid 532*a* reserved in the reservoir 532 to the surface 50*a* of the liquid absorbing member 50 by drawing it up. The moisturizing liquid 532*a* is, for example, water. The moisturizing liquid 532*a* may contain a water-soluble organic solvent or a surfactant.

The surface 50*a* may be thickened by using the liquid absorbing member 50, and this may degrade performance of absorbing the liquid component from the ink image IM. It is possible to suppress thickening of the surface 50*a* and maintain the performance of absorbing the liquid component by applying the moisturizing liquid 532*a* to the surface 50*a*.

In this embodiment, an arrangement that draws up the moisturizing liquid 532*a* to the surface 50*a* of the liquid absorbing member 50 by the application roller 531 is adopted. However, another arrangement such as an arrangement that sprays the moisturizing liquid 532*a* to the surface 50*a* by a nozzle may also be adopted.

The recovery unit 54 is an apparatus that removes the liquid component absorbed by the liquid absorbing member 50 from the liquid absorbing member 50 and includes, in this embodiment, a nozzle 540 that ejects air and a reservoir 541 that stores the removed liquid component. The nozzle 540 blows the air to the surface 50*b* of the liquid absorbing member 50 and with that pressure, removes the liquid component absorbed into the reverse layer 502 to be blown off. By removing the liquid component from the reverse layer 502, it is possible to recover the liquid absorption capacity of the liquid absorbing member 50 while suppressing drying of the moisture surface 50*a* by the recovery unit 53.

In this embodiment, the nozzle 540 has an air ejection direction toward the driven rotating body 511 and ejects the air to the liquid absorbing member 50 backed up by the driven rotating body 511. It is therefore possible to suppress deformation in the liquid absorbing member 50 even if an air pressure is increased. Moreover, the air ejection direction of the nozzle 540 is directed to a direction crossing the thickness direction of the liquid absorbing member 50. It is therefore possible to remove the liquid component while suppressing its backward flow from the reverse layer 502 to the obverse layer 501. The reservoir 541 is arranged so as to surround an air ejection position of the driven rotating body 511 and can capture the removed liquid component more reliably.

Air ejection from the nozzle 540 may always be performed during the operation of the printing system 1, or may intermittently or periodically be performed in accordance with an absorption status of the liquid component of the liquid absorbing member 50. In this embodiment, an arrangement that removes the liquid component from the liquid absorbing member 50 by ejecting the air is adopted. However, another arrangement can also be adopted. For example, an arrangement that removes the liquid component by bringing a roller having a liquid absorber on its peripheral surface into contact with the liquid absorbing member 50, an arrangement that squeezes the liquid component by pressing a squeezing roller against the liquid absorbing member 50, or the like can be adopted.

As described above, in this embodiment, an arrangement is adopted in which the recovery units 52 to 54 perform recovery processing in the processing order of the removal of the dust particle, moisturizing, and the removal of the liquid component from an upstream side to a downstream side in the running direction of the liquid absorbing member 50. The processing order is not limited to this. According to the processing order of this embodiment, however, the recovery unit 53 moisturizes the surface 50*a* after the recovery unit 52 cleans the surface 50*a*, making it possible to promote the removal of the dust particle and an improvement in moisture retention. Moreover, the recovery unit 54 removes the liquid component relatively on the downstream side, making it possible to remove the liquid component in a place where the surface 50*b* runs at a high position in the vertical direction. This has the advantage that air is easily blown to the surface 50*b* and in addition, the removed liquid component is easily collected by using gravity.

The preprocessing unit 55 will be described next. The preprocessing unit 55 is an apparatus that mainly performs preprocessing for making full use of the liquid absorption performance of the liquid absorbing member 50 in a short time at the start of the operation of the printing system 1 or the like. In this embodiment, a preprocessing liquid is applied to the surface 50*a* of the liquid absorbing member 50, improving a rise in liquid absorption performance. For example, when the obverse layer 501 is made of the water-repellent material, the preprocessing liquid can use a surfactant. F-444 (trade name, available from DIC), ZonylFS3100 (trade name, available from DuPont), CapstoneFS-3100 (trade name, available from The Chemours Company LCC) of a fluorochemical surfactant, BYK349 (trade name, available from BYK) of a silicone-based surfactant, or the like is given as the surfactant.

The preprocessing unit 55 adopts the same mechanism as the recovery units 52 and 53. That is, the preprocessing unit 55 includes an application roller 551, a reservoir 552, a support member 553, and a moving mechanism 554. The support member 553 supports the application roller 551 rotatably about the axis in the Y direction and also supports the reservoir 552. A preprocessing liquid 552*a* is reserved in the reservoir 552. The application roller 551 is partially immersed in the preprocessing liquid 552*a*. The moving mechanism 554 is a mechanism that moves the support member 553 and is, for example, an electrically-driven cylinder. The application roller 551 and the reservoir 552 also move together with the support member 553. They are moved in the direction of an arrow d5 (here, the horizontal direction) between an application position at which the application roller 551 contacts the liquid absorbing member 50 and a retracted position at which the application roller 551 is separated from the liquid absorbing member 50. FIG. 8 shows a state in which the application roller 551 is located at the retracted position. The application roller 551 can move to the application position at the start of the operation of the printing system 1 or periodically (for example, in the unit of the number of print media P to be processed).

The application roller 551 is arranged facing the driven rotating body 511. The liquid absorbing member 50 is nipped by the application roller 551 and the driven rotating body 511 at the application position. The application roller 551 rotates in accordance with running of the liquid absorbing member 50. The peripheral surface of the application roller 551 is formed by, for example, rubber and supplies the preprocessing liquid 552*a* reserved in the reservoir 552 to the surface 50*a* of the liquid absorbing member 50 by drawing it up.

With the above arrangement, the absorption unit 5B removes the liquid component from the ink image IM on the transfer member 2 by the liquid absorbing member 50. The liquid component can be removed from the ink image IM continuously by removing the liquid component simultaneously with cyclical movement of the liquid absorbing member 50, making it possible to remove the liquid component without replacing the liquid absorbing member 50 during a predetermined operation period. In addition, the liquid absorption performance of the liquid absorbing member 50 can be maintained for a longer period by providing the recovery units 52 to 54, making it possible to prolong a replacement cycle of the liquid absorbing member 50.

<Another Arrangement Example of Absorption Unit>

Figure 10:
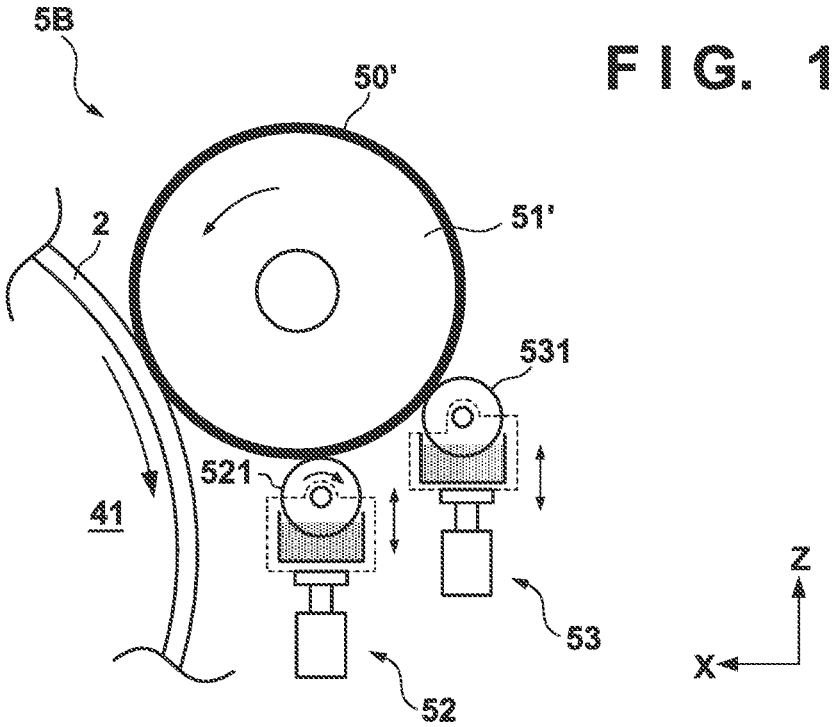
FIG. 10 is a schematic view showing another example of the absorption unit.

In the above-described embodiment, the liquid absorbing member 50 is formed into an endless swath and configured to run cyclically. However, another arrangement can also be adopted. FIG. 10 shows an example of this. In the example of FIG. 10, a support unit 51' includes a rotating body such as a roller that can rotate about the axis in the Y direction, and a liquid absorbing member 50' is disposed on its peripheral surface. The liquid absorbing member 50' moves cyclically by rotating the support unit 51'. The recovery units 52 and 53 are exemplarily arranged in the middle of a moving path of the liquid absorbing member 50'. It is also possible to provide a mechanism corresponding to the above-described recovery unit 54 and a mechanism corresponding to the above-described preprocessing unit 55.

The support unit 51' may rotate in accordance with the transfer drum 41 or may include a driving mechanism that rotates the support unit 51' independently.

Other Embodiments

In the above embodiment, the print unit 3 includes the plurality of printheads 30. However, an arrangement may include one printhead 30. The printhead 30 need not be a full-line head but may be of a serial type that forms an ink image while scanning the printhead 30 in a Y direction.

A conveyance mechanism of a print medium P may adopt another method such as a method of nipping and conveying the print medium P by a pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming the transfer member 2 into an endless swath and running it cyclically may be adopted.

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A liquid absorbing apparatus for absorbing a liquid component from an ink image formed on a transfer member, which passes through a formation area where the ink image is formed and a transfer area cyclically, before transferring the ink image to a print medium, comprising:

a liquid absorbing member comprising an endless sheet and configured to absorb the liquid component at a position between the formation area and the transfer area in a moving direction of the transfer member, the formation area being positioned on an upstream side of the transfer area with respect to the moving direction of the transfer member;

a support unit configured to support the liquid absorbing member to be movable cyclically;

a first recovery unit configured to apply a moisturizing liquid to the liquid absorbing member at a first position in a moving path of the liquid absorbing member, and a second recovery unit configured to remove the liquid component from the liquid absorbing member at a second position in the moving path on a downstream side of the first position.

2. The liquid absorbing apparatus according to claim 1, wherein the sheet has a first surface contacting the ink image, and a second surface opposite to the first surface, the first recovery unit is configured to apply the moisturizing liquid to the first surface, and the second recovery unit is configured to remove the liquid component from the second surface.

3. The liquid absorbing apparatus according to claim 1, further comprising a third recovery unit configured to remove a dust particle from the liquid absorbing member.

4. The liquid absorbing apparatus according to claim 1, wherein the support unit includes a driving rotating body configured to move the sheet, and the driving rotating body is driven so that the sheet moves in synchronism with movement of the transfer member.

5. The liquid absorbing apparatus according to claim 4, further comprising a sensor configured to detect a moving speed of the sheet while contacting the sheet, wherein the driving rotating body is driven based on a detection result of the sensor.

6. The liquid absorbing apparatus according to claim 1, wherein the ink image is formed by aqueous ink, and the liquid absorbing member absorbs at least water from the ink image.

7. A printing apparatus comprising:

a transfer member configured to pass through a formation area and a transfer area of an ink image cyclically;

a print unit configured to form an ink image on the transfer member by discharging ink to the transfer member in the formation area;

a transfer unit configured to transfer the ink image from the transfer member to a print medium; and a liquid absorbing unit configured to absorb a liquid component from the ink image on the transfer member before the transfer by the transfer unit, wherein the liquid absorbing unit includes:

a liquid absorbing member comprising an endless sheet and configured to absorb the liquid component at a position between the formation area and the transfer area in a moving direction of the transfer member, the formation area being positioned on an upstream side of the transfer area with respect to the moving direction of the transfer member, a support unit configured to support the liquid absorbing member to be movable cyclically, a first recovery unit configured to apply a moisturizing liquid to the liquid absorbing member at a first position in a moving path of the liquid absorbing member, and a second recovery unit configured to remove the liquid component from the liquid absorbing member at a second position in the moving path on a downstream side of the first position.

8. A printing method of transferring an ink image to a print medium via a transfer member which passes through a formation area where the ink image is formed and a transfer area cyclically, comprising:

forming an ink image on the transfer member by discharging ink to the transfer member in the formation area;

absorbing a liquid component from the ink image on the transfer member at a position between the formation area and the transfer area in a moving direction of the transfer member, the formation area being positioned on an upstream side of the transfer area with respect to the moving direction of the transfer member after the forming the ink image; and transferring the ink image from the transfer member to the print medium in the transfer area after the absorbing the liquid component, wherein the absorbing the liquid component includes:

cyclically moving a liquid absorbing member comprising an endless sheet and configured to absorb the liquid component from the ink image, recovering by applying a moisturizing liquid to the liquid absorbing member at a first position in a moving path of the liquid absorbing member concurrently with the cyclically moving the liquid absorbing member, and recovering by removing the liquid component from the liquid absorbing member at a second position in the moving path on a downstream side of the first position concurrently with the cyclically moving the liquid absorbing member.

9. A manufacturing method of manufacturing a printed product by transferring an ink image to a print medium via a transfer member which passes through a formation area where the ink image is formed and a transfer area cyclically, comprising:

forming an ink image on the transfer member by discharging ink to the transfer member in the formation area;

absorbing a liquid component from the ink image on the transfer member after the forming the ink image at a position between the formation area and the transfer area in a moving direction of the transfer member, the formation area being positioned on an upstream side of the transfer area with respect to the moving direction of the transfer member; and transferring the ink image from the transfer member to the print medium in the transfer area after the absorbing the liquid component, wherein the absorbing the liquid component includes:

cyclically moving a liquid absorbing member comprising an endless sheet and configured to absorb the liquid component from the ink image, recovering by applying a moisturizing liquid to the liquid absorbing member at a first position in a moving path of the liquid absorbing member concurrently with the cyclically moving the liquid absorbing member, and recovering by removing the liquid component from the liquid absorbing member at a second position in the moving path on a downstream side of the first position concurrently with the cyclically moving the liquid absorbing member.

10. The liquid absorbing apparatus according to claim 1, wherein the liquid absorbing member passes the first position, the second position and the position between the formation area and the transfer area in the listed order.

11. The printing apparatus according to claim 7, wherein the liquid absorbing member passes the first position, the second position and the position between the formation area and the transfer area in the listed order.

12. The printing method according to claim 8, wherein the liquid absorbing member passes the first position, the second position and the position between the formation area and the transfer area in the listed order.

13. The manufacturing method according to claim 9, wherein the liquid absorbing member passes the first position, the second position and the position between the formation area and the transfer area in the listed order.

* * * * *